United States Patent [19]

Hughes et al.

[11] 4,327,958

[45] May 4, 1982

[54] CONNECTOR JACK

[75] Inventors: Donald W. K. Hughes, Mechanicsburg; Ronald W. Myers, Landisburg; Charles H. Weidler, Lancaster, all of Pa.

[73] Assignee: AMP Incorporated, Harrisburg, Pa.

[21] Appl. No.: 146,807

[22] Filed: May 5, 1980

[51] Int. Cl.[3] ..... H01R 4/24

[52] U.S. Cl. ..... 339/276 SF; 339/97 R

[58] Field of Search ..... 339/276 SF, 97 R, 97 P, 339/98, 99 R, 176 M, 126 R; 179/1 PC

[56] References Cited

U.S. PATENT DOCUMENTS

| | | | |
|---|---|---|---|
| 3,760,335 | 9/1973 | Roberts | 339/99 R |
| 3,850,497 | 11/1974 | Krumruch et al. | 339/126 R |
| 4,159,158 | 6/1974 | Weidler | 339/97 P |
| 4,188,505 | 2/1980 | O'Connor | 179/1 PC |
| 4,210,376 | 7/1980 | Hughes et al. | 339/17 LC |

FOREIGN PATENT DOCUMENTS

| | | | |
|---|---|---|---|
| 2604269 | 8/1976 | Fed. Rep. of Germany | 339/97 R |

*Primary Examiner*—Eugene F. Desmond

*Attorney, Agent, or Firm*—Frederick W. Raring

[57] ABSTRACT

Sub-assembly for a modular jack comprises an insulating support, which is dimensioned to be assembled to a jack housing having a group of stamped and formed conductors mounted on the support. The conductors have plate-like wire-receiving portions which are provided with wire-receiving slots so that wires can be connected to the conductors by movement of the wires into the slots. The sub-assemblies are produced as a continuous composite strip comprising a continuous strip of conductors with support members assembled to the groups of conductors of the metallic strip.

8 Claims, 14 Drawing Figures

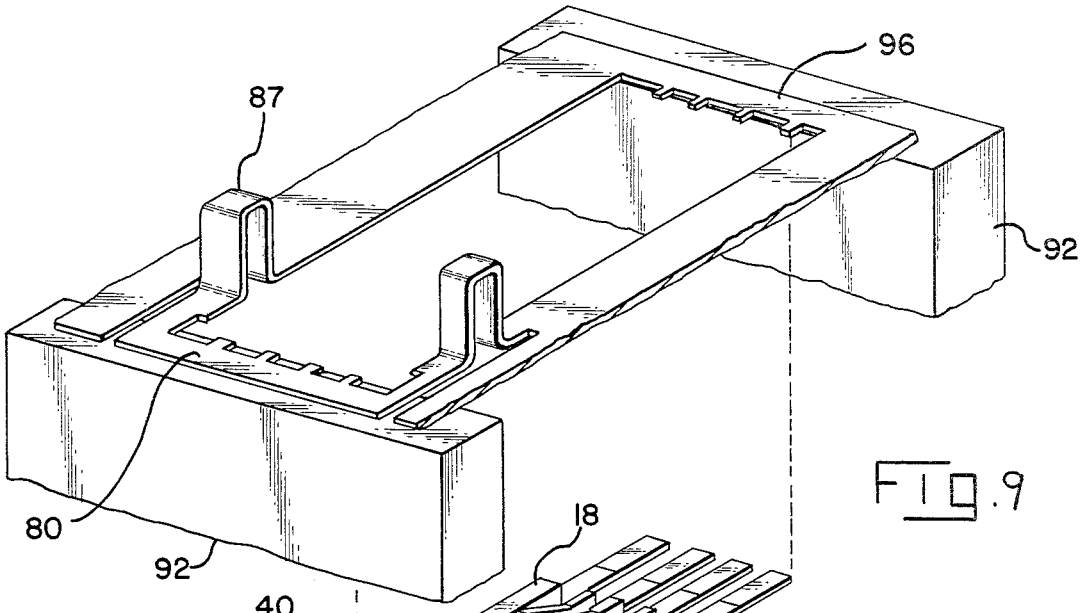
FIG. 9
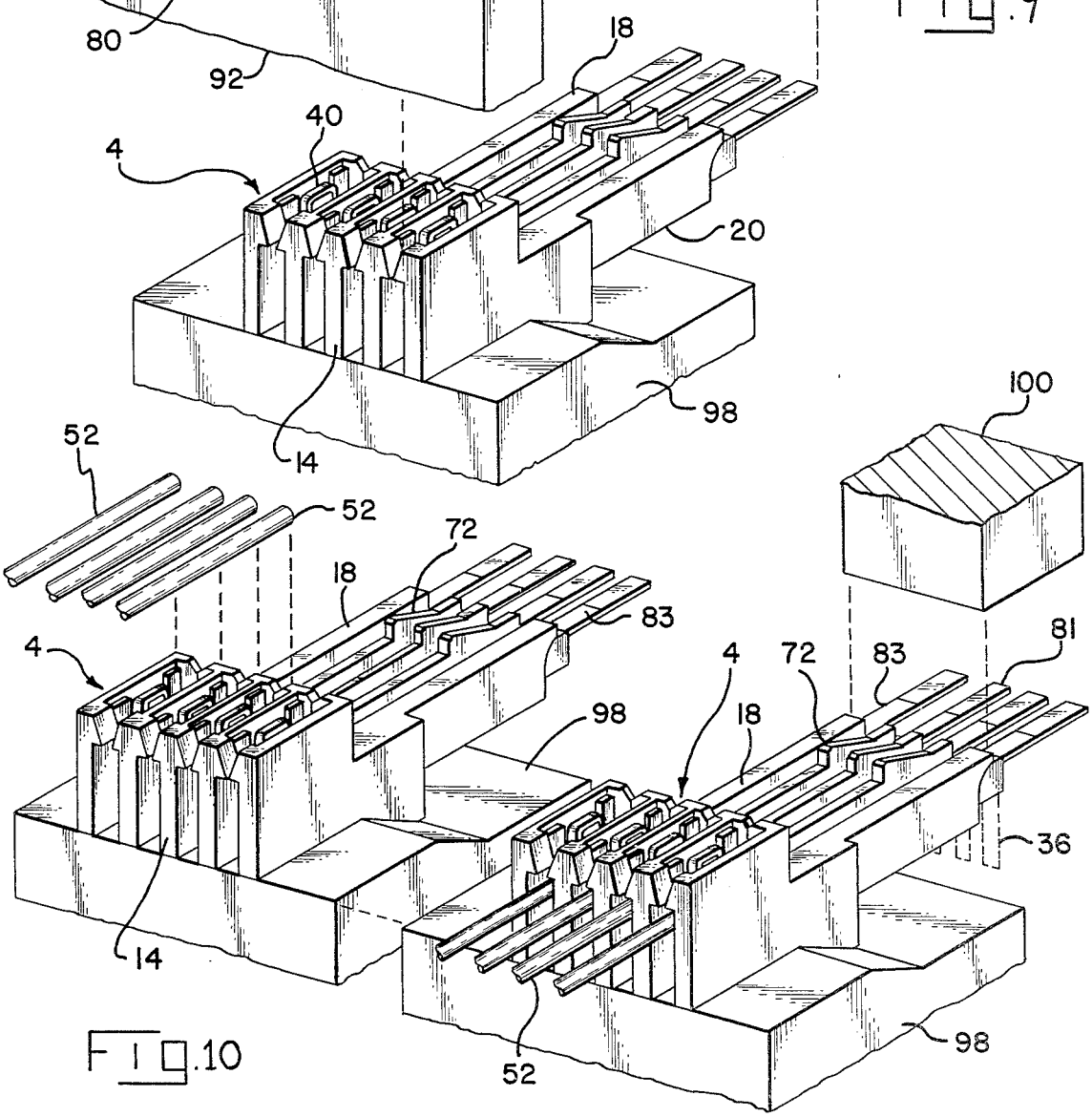
FIG. 10
FIG. 11

CONNECTOR JACK

FIELD OF THE INVENTION

This invention relates to electrical connector assemblies of the type referred to as "modular jacks" and particularly to a sub-assembly comprising an insulating support having the jack conductors assembled thereto and which is dimensioned to be assembled to a jack housing shell.

BACKGROUND OF THE INVENTION

A widely used type of electrical connector receptacle, which is commonly referred to as a modular jack, comprises an insulating housing having a plurality, usually four to eight, of side-by-side conductors therein. The conductors are connected to wires which extend from the housing and have contact spring portions which extend from the housing and into a plug-receiving opening in the front of the housing. Receptacles of this type are dimensioned to receive connector plugs installed on the ends of wires and which have terminals therein that engage the contact spring portions of the conductors in the jack when the plug is inserted into the modular jack housing. The conductors may be drawn wire and connected to the wires extending from the jack receptacle by crimped connections, or they may be stamped and formed conductors, as shown, for example, in U.S. Pat. No. 4,193,645. The modular jack conductors of this patent are intended to be inserted into holes in a circuit board and soldered to circuit board conductors.

While modular jack housings are usually produced as one-piece moldings having openings which receive the jack conductors, it is also common practice to mount the jack conductors in a support member which in turn is intended for assembly to a housing shell to produce a jack assembly consisting of the support member and the housing shell. The use of separate support members or sub-assemblies in this manner is advantageous in that a support member can be used with a wide variety of housing shells. For example, U.S. Pat. No. 4,088,384 shows the use of a jack sub-assembly in conjunction with an adaptor having a cover member with which the housing shell is integral. It is frequently desirable to mold the housing shell integrally with another part, such as the housing of a telephone instrument or a circuit box. These sub-assemblies can also be used with separate housing shells which may be designed for mounting under particular circumstances and have different types of mounting means integral therewith. The subassembly shown in the above identified U.S. Pat. No. 4,088,384 has conventional drawn wire conductors therein, which are connected to insulated wires by means of crimped connections. As mentioned above, stamped and formed conductors are also used for modular jacks and offer advantages under many circumstances.

It would be desirable to provide a jack sub-assembly having stamped and formed conductors therein rather than drawn wire conductors as disclosed in the above identified U.S. Pat. No. 4,088,384. It would also be desirable to provide an improved means for connecting the wires which extend from the jack to the jack conductors and avoid the need for using a crimped connection. It would, furthermore, be desirable to produce modular jack sub-assemblies of the type comprising an insulating support having conductors assembled thereto in a form which would permit a higher degree of automation than can be achieved with presently known modular jack sub-assemblies. Present assembly methods require that the drawn wire conductors be connected by crimped connections to the insulated wire conductors and then inserted either manually or by relatively complex insertion machinery into the support member. It would be preferable to have a jack sub-assembly which would permit these operations to be carried out with automatic or semiautomatic machines. The present invention is directed to the achievement of an improved modular jack sub-assembly which will meet these requirements of the industry.

A modular jack sub-assembly in accordance with the present invention comprises a molded insulating support member having side-by-side channels on one surface thereof and conductor-receiving cavities at its rearward end in alignment with these channels. The conductors are of stamped and formed sheet metal and each conductor has at its rearward end plate-like sections having wire-receiving slots therein which are dimensioned to be received in the cavities in the support. The sub-assemblies are produced as a continuous composite strip comprising a continuous strip of stamped and formed conductors with insulating support members assembled to the conductors. This composite strip can be fed to processing machinery, such as wire insertion machines, for inserting wires into the wire-receiving portions of the conductors and severing and shearing devices for shearing the individual sub-assemblies from the composite strip. These operations can be carried out by feeding the composite strip to the processing machinery and since the wire-inserting and severing operations can be carried out by specialized inserting and severing apparatus, substantial economies in the production of the finished sub-assemblies can be achieved.

DESCRIPTION OF THE DRAWINGS

FIGS. 9, 10, and 11 are views similar to FIG. 7, but showing successive stages in the processing of a sub-assembly after it has been severed from a strip of sub-assemblies.

PRACTICE OF THE INVENTION

Figure 1:
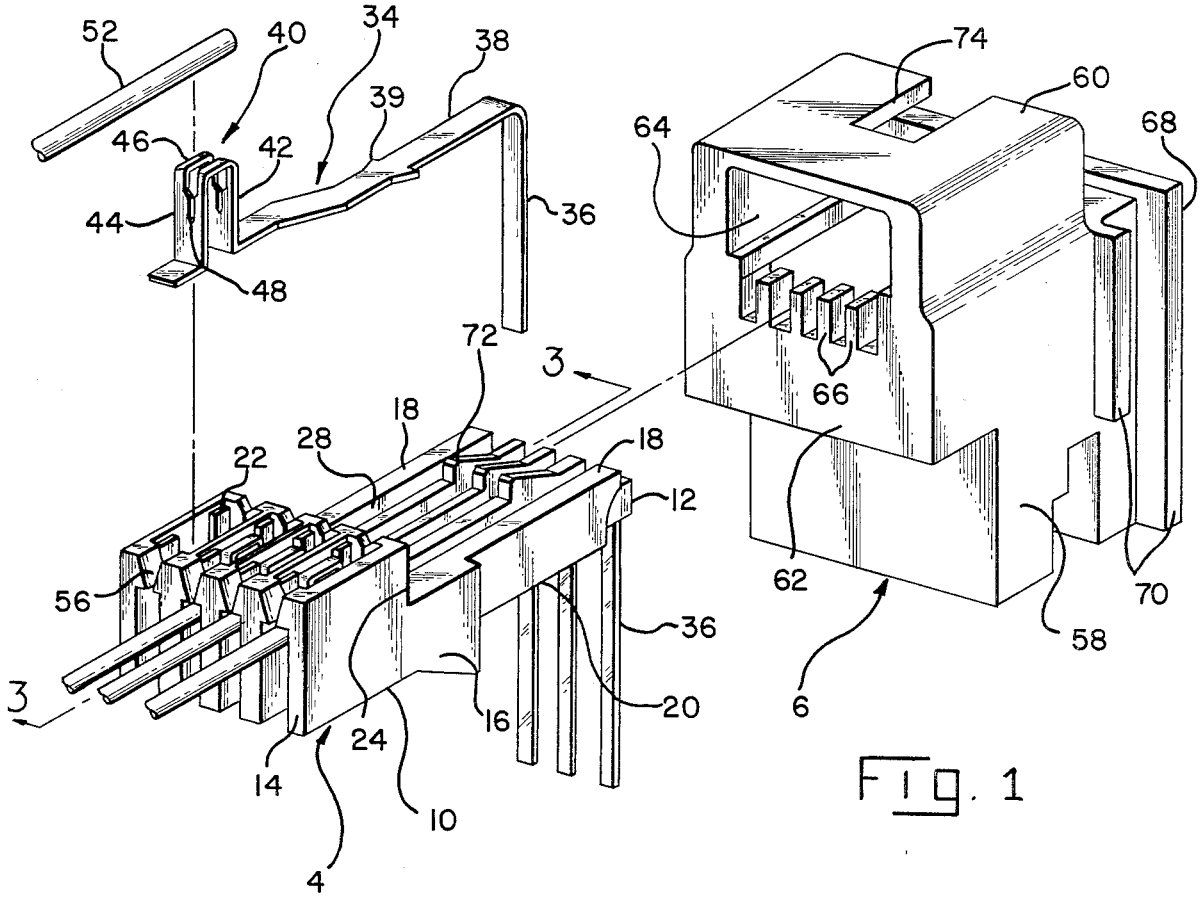
FIG. 1 is a perspective view showing a jack housing, a modular jack sub-assembly exploded from the housing, and a conductor exploded from the sub-assembly.
Figure 2:
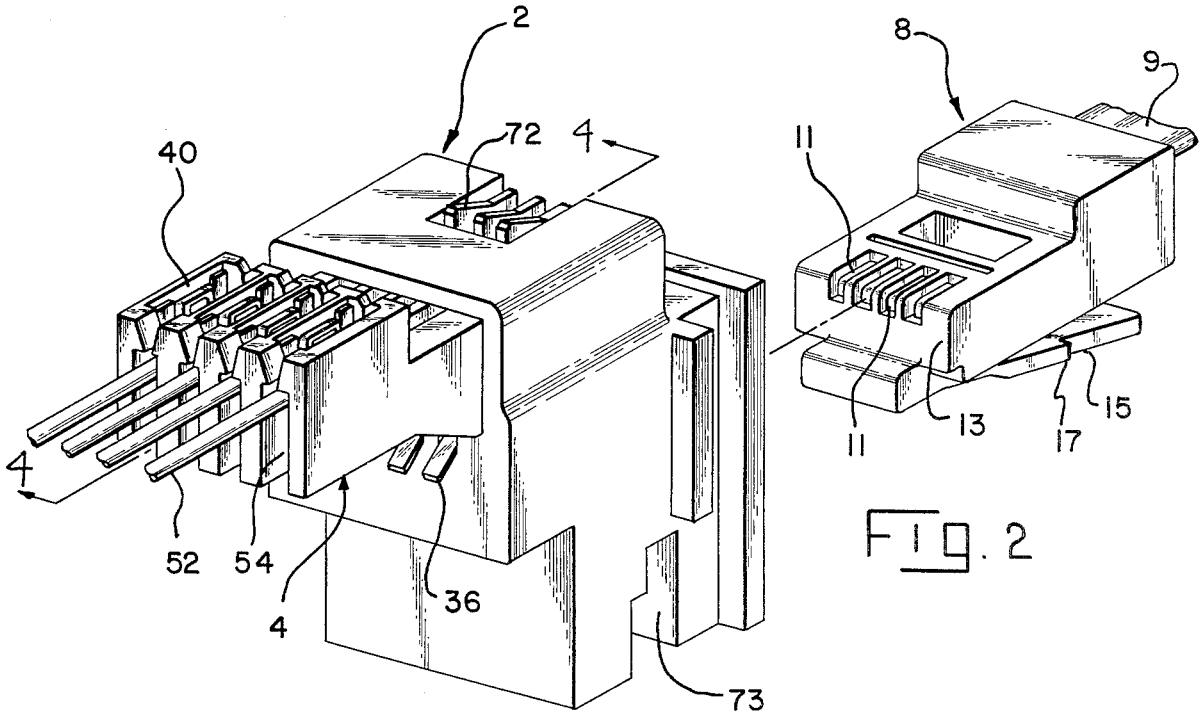
FIG. 2 is a view showing the jack assembly comprising the sub-assembly to the housing shell.

A connector jack assembly 2, FIGS. 1–4, in accordance with the invention comprises a sub-assembly 4 which is inserted into a jack housing shell 6. The jack assembly 2 is dimensioned to receive a standard type of modular plug 8 which is installed on one end of a multi-conductor cable 9 and which has terminals 11 therein at its leading end 13, as shown at 11, which are in contact with the conductors in the cable 9. A latch arm 15 is provided on the underside of the plug and this latch arm has rearwardly facing shoulders 17 which cooperate with retaining shoulders in the jack assembly, as will be explained below, to retain the plug within the jack assembly.

The support member 10 comprises a molded block of insulating material having a first or front end 12, a second or rearward end 14, side surfaces 16, and first and second major surfaces 18, 20 which extend between the ends. The support member 10 is enlarged at its rearward end 14 and provided with a plurality of side-by-side conductor-receiving cavities 22 which are open at their upper ends and which have front walls facing forwardly, as shown at 24. Slots are provided in these front walls and extend to side-by-side channels 28 in the surface 18 and which receive the conductors 34, as described below. The channels extend around the front or forward end 12, as shown in FIG. 3, to the downwardly facing major surface 20, the inner surface of the channels being arcuate as shown at 32, to permit bending of the conductors inwardly.

The individual conductors 34 are of stamped and formed conductive sheet metal, such as brass or phosphor bronze, and each has a forward contact spring portion 36, an intermediate portion 38, and a wire-connecting portion 40. Barbs 39 extend outwardly from the side edges of the intermediate portion and function to retain the individual conductors in the channels 22 when they are inserted into the channels. The wire-connecting portions 40 each comprise a pair of parallel plate-like members 42, 44 which are connected at their upper free ends by spaced-apart strap members 46. Wire-receiving slots 48 are provided in these plate-like members so that when a wire 52 is moved laterally of its axis, between the connecting strap portions 46, and into the slots 48, the edges of the slots will penetrate the insulation of the wire and establish contact with the conducting core.

Figure 3:
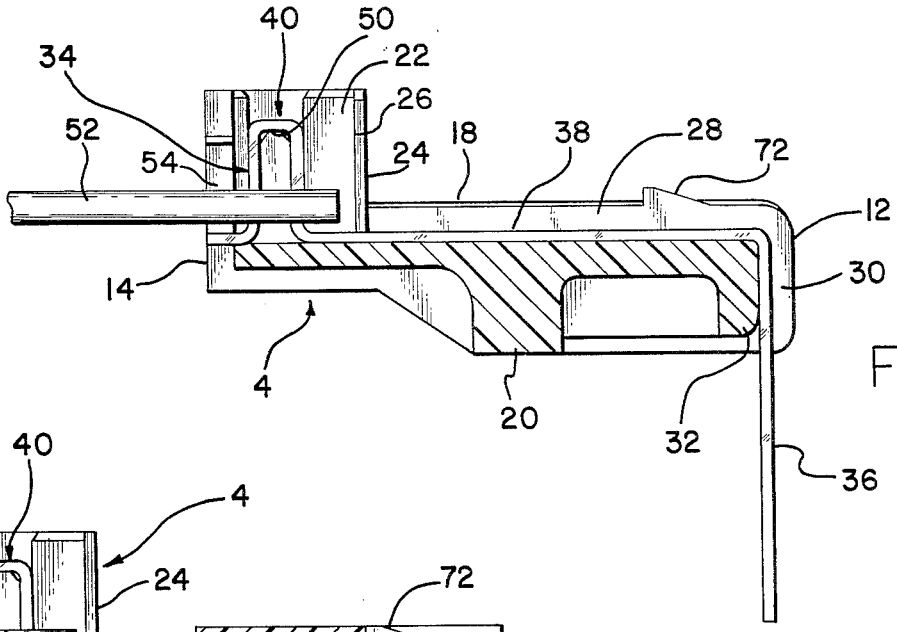
FIGS. 3 and 4 are views taken along the lines 3—3 and 4—4 of FIGS. 1 and 2 respectively.

The opposed walls of the cavities 22 have upwardly facing, as viewed in the drawing, 50 shoulders which are disposed beneath the connecting strap portions 46 when the conductors are assembled to the support member, as shown in FIG. 3. These shoulders thus support the wire-connecting portions of the conductors during insertion of the wires, so that the plate-like members are placed in tension during the wire inserting process. The function of these shoulders is described more fully in U.S. Pat. NO. 4,159,158.

After insertion, the wires extend through the open rear ends 54 of the individual cavities and during insertion, the wires as they move into the cavities pass constricted portions 56 of the cavity openings which permit downward movement of the wires but which prevent upward movement thereof and thereby ensure that the wires will remain connected to the conductors in the sub-assembly.

Figure 4:
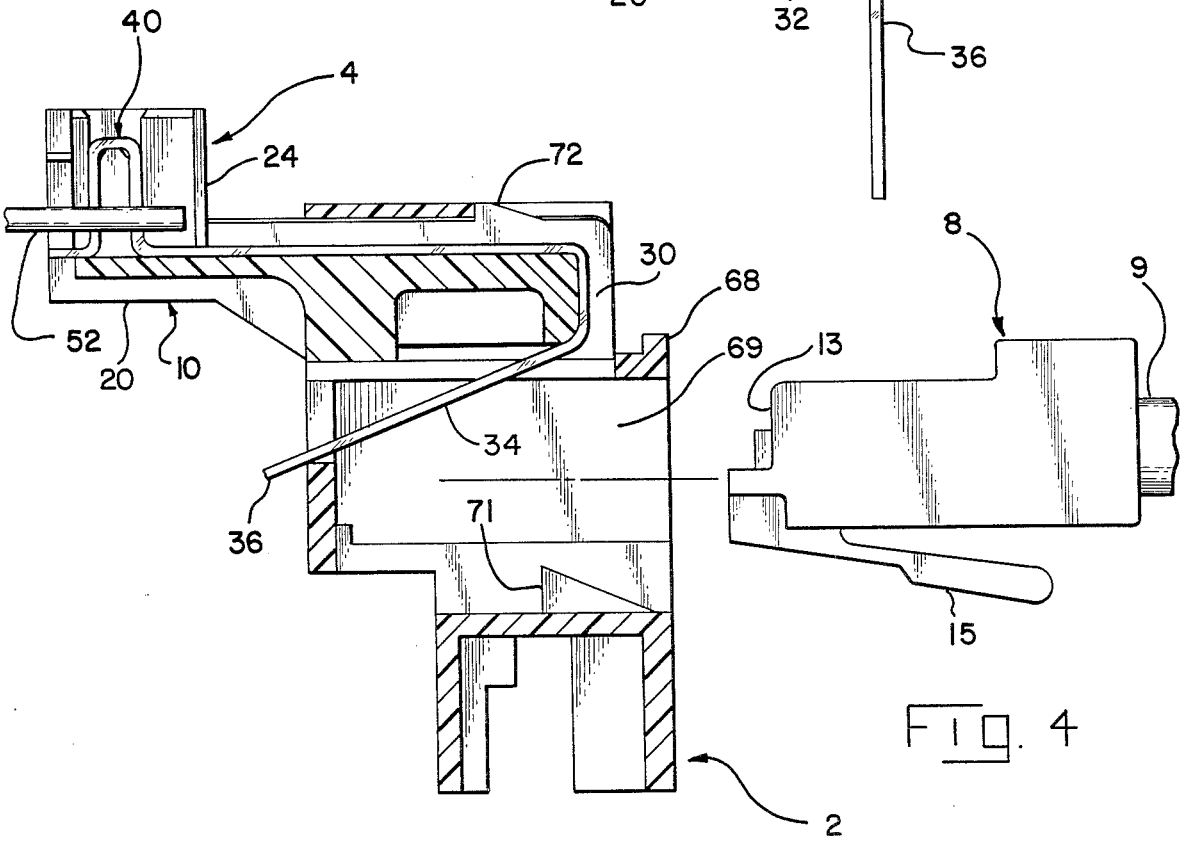
Figure 6:
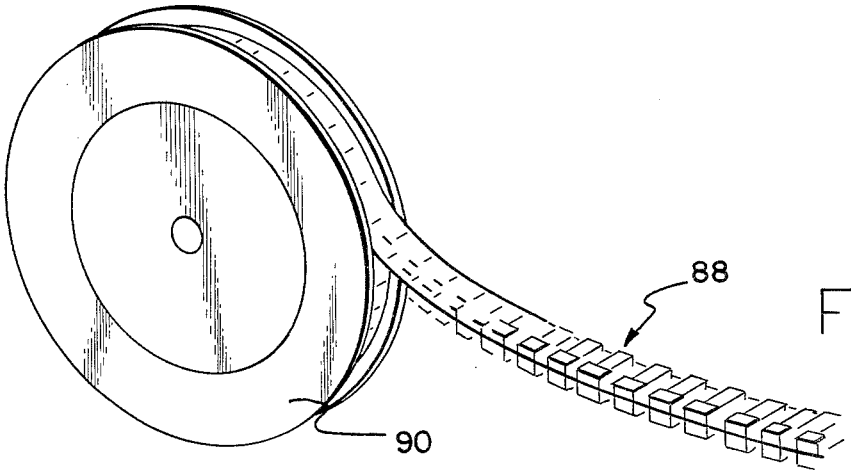
FIG. 6 is a view showing the composite strip wound on a reel.

The housing shell 6 is molded of suitable thermoplastic material and has sidewalls 58, a top wall 60, and one end or face 62 in which there is provided an opening 64 dimensioned to receive the sub-assembly 4, as indicated in FIG. 1. Spaced-apart barriers 66 extend upwardly from the lower edge of opening 64 and after insertion of the sub-assembly 4 into the housing shell, the ends of the contact spring portion 36 of the conductors will be captured between adjacent barriers as best shown in FIG. 4. The plug-receiving end 68 of the housing shell has a plug-receiving opening 69 therein and this opening has shoulders 71 which cooperate with the previously identified shoulders 17 on the latch arm 15 of the plug. It will thus be apparent from FIG. 4, that upon insertion of the plug into the opening 69, the terminals 11 in the plug will engage the contact spring portions 36 of the conductors 34 and the wires in the cable 9 will thus be connected to the wires 50 extending from the jack assembly.

The sub-assembly 4 is retained in the housing shell 6 by means of ears 72 which extend upwardly from the surface 18 of the support 10. As the sub-assembly is inserted into the opening 64, the top wall 60 of the shell flexes slightly to permit passage of these ears until they reach a notch 74 in the top wall 60. Thereafter, the leftwardly, as viewed in FIG. 4, surfaces on the ears prevent removal of the sub-assembly 4 from the housing shell. The particular housing shell 6, shown in the drawing, has spaced-apart flanges 70 which receive a panel member on which the jack assembly is mounted and a notch 73 is provided in the lower end of the housing shell, which is also dimensioned to receive a projection on the member on which the assembly is mounted. As mentioned previously, the housing shell may take a variety of forms depending upon the circumstances under which it is used and quite frequently, this housing shell will be molded integrally with another part, such as a cover member or a housing for a piece of equipment or an instrument.

Referring now to FIGS. 5–11, sub-assemblies 4 in accordance with the invention are produced by first stamping and forming a continuous strip of conductive sheet metal 76 to provide side-by-side flat blanks 81, each blank consisting of a group of conductor blanks separated from adjacent groups by separator strips 86. The strip of blanks has spaced-apart first and second carrier strips 78′, 80′.

The portions of the flat blanks are identified by the same reference numerals, differentiated by prime marks, as those used to describe the conductor in its formed condition. Each conductor thus has a first end which is integral with the first carrier strip 78′ and a second end which is integral with the second carrier strip 80′. Adjacent conductors in the flat blank are connected by short connecting sections 82 which are subsequently removed in a shearing operation. The transversely extending separator strips are notched, as shown at 84, between-adjacent groups of conductors to permit forming of the wire-connecting portions 40 of the individual conductors from the flat blanks. When the wire-connecting portions are formed by bending the blanks, the carrier strip 80 is moved relatively towards the carrier strip 78 and the connecting or separator strips 86 are formed into U-shaped, as are the wire-connecting portions of the conductors.

Figure 5:
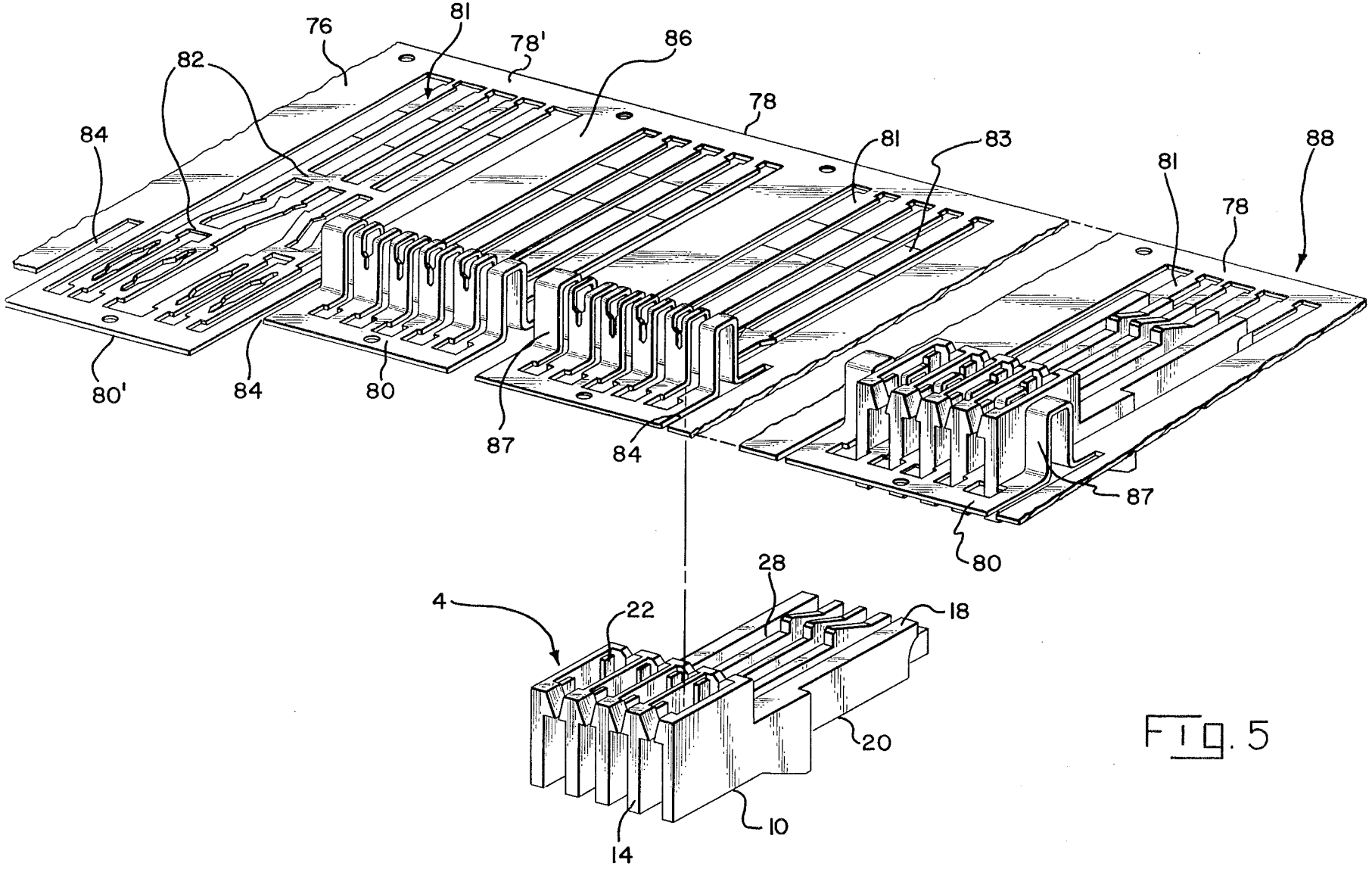
FIG. 5 is a perspective view illustrating the steps in producing a continuous composite strip of modular jack sub-assemblies.

After forming of the strip, the intermediate portions 38 of the conductors, the contact spring portions 36, and the carrier strips 78, 80 will lie in a single plane and the wire-connecting portions 40 of the conductors will extend normally of this single plane. The support members 10 are then assembled to the conductors by merely aligning an individual support member with a group of conductors, as shown in FIG. 5, and moving the support member relatively towards the conductors until the conductors enter the channels 28 and the wire-connecting portions 40 enter the cavities 22. The barbs 39 will function to retain the support members 10 on the metal strip and the composite strip 88 is thus produced which can be wound on a reel, as shown at 90.

The steps of forming the metal strip of conductors and assembling the support members to the metal strip can be carried out in a manufacturing and assembly process at one site and the strip 88, after being wound on a reel, can be transported to another side at which the strip is processed, as shown in FIGS. 7–11. Thus, the operations shown in FIG. 5 would be carried out by the manufacturer and supplier of the composite strip 88, while the processing operations shown in FIGS. 7–11 would be carried out by the user of a composite strip who would ordinarily be a manufacturer of equipment, such as telephone equipment, which requires modular jacks.

Figure 7:
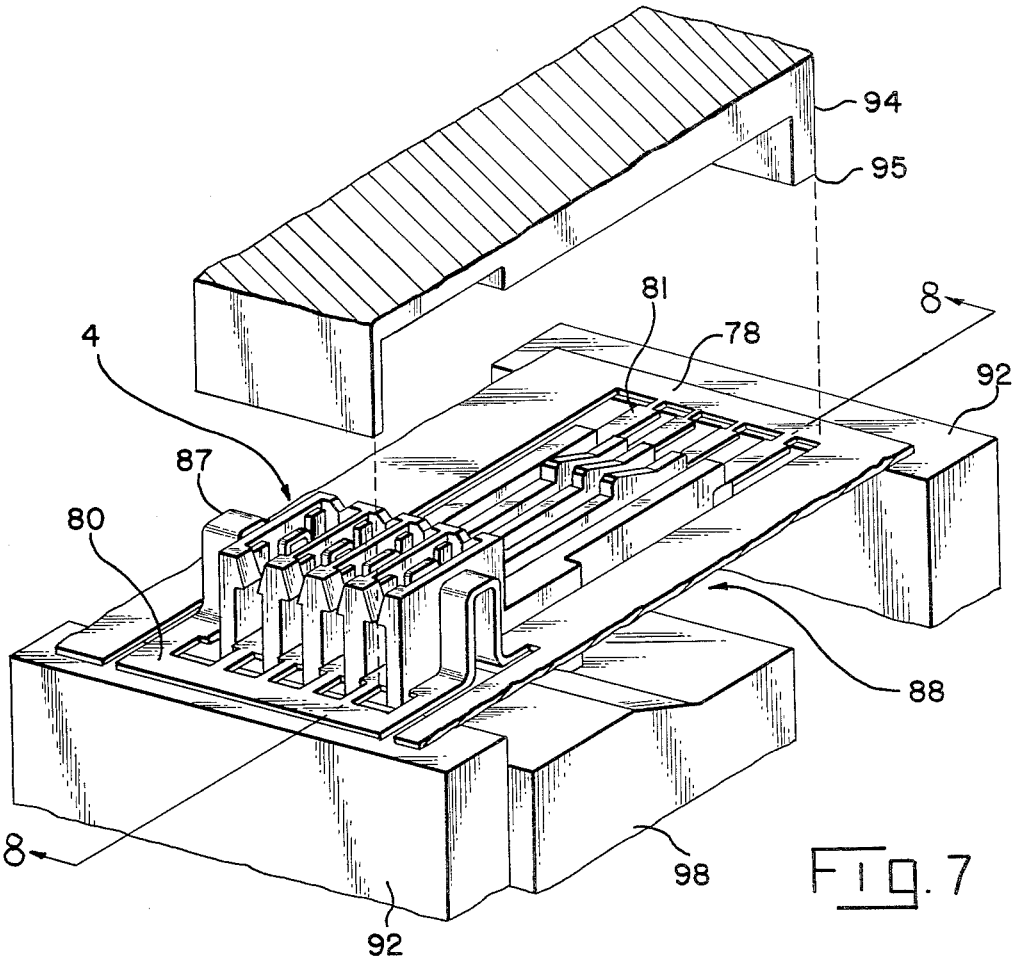
FIG. 7 is a fragmentary view showing severing apparatus for severing an individual sub-assembly from the composite strip of sub-assemblies.
Figure 8:
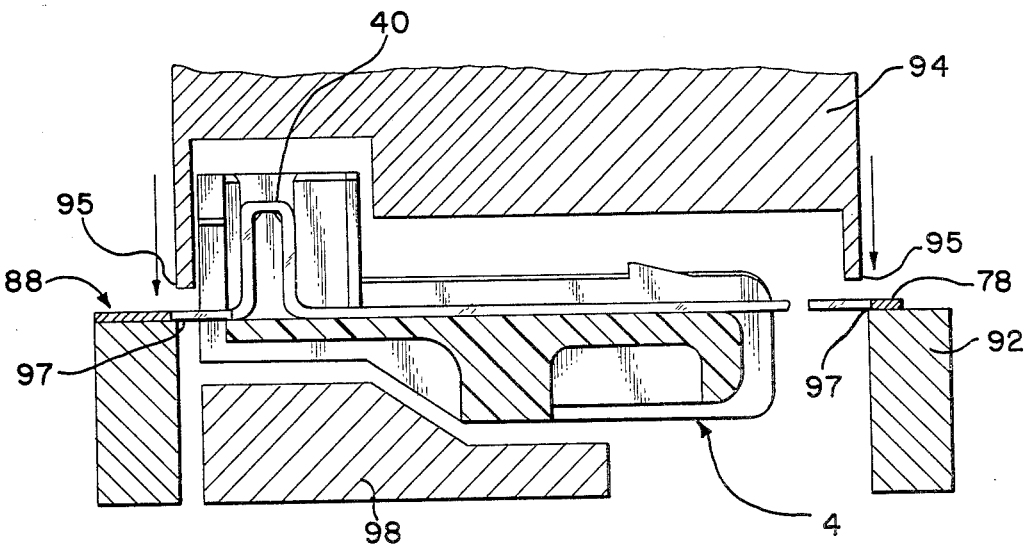
FIG. 8 is a view taken along the lines 8—8 of FIG. 7, but with the upper shearing die in a lowered position.

As shown in FIG. 7, an individual sub-assembly 4 is removed from a strip of sub-assemblies by shearing members 92, 94 which sever the first ends of the conductors from the carrier strip 78 and sever the second ends of the conductors from the carrier strip 80. These shearing members 92, 94 have shearing edges, as shown at 95, 97 in FIG. 8, which leave scrap strip as shown at 96. After shearing, the individual sub-assembly is supported on a support member 98 by means of which it is carried to a wire insertion station, shown in FIG. 10. The individual wires are inserted into the wire-connecting portions 40 of the conductors at this station and this operation may be carried out by any suitable multiple wire insertion apparatus. After insertion of the wires, the sub-assembly is transported to a forming station at which a bending die 100 bends the contact portions 36 of the conductors downwardly from the positions they occupy in FIG. 11 to the positions they occupy in FIG. 1.

The sub-assemblies can now be inserted into the housing 6 and during insertion, the contact portions 36 will be bent rearwardly so that they will occupy the positions shown in FIG. 4 and extend diagonally into the opening 69.

Figure 12:
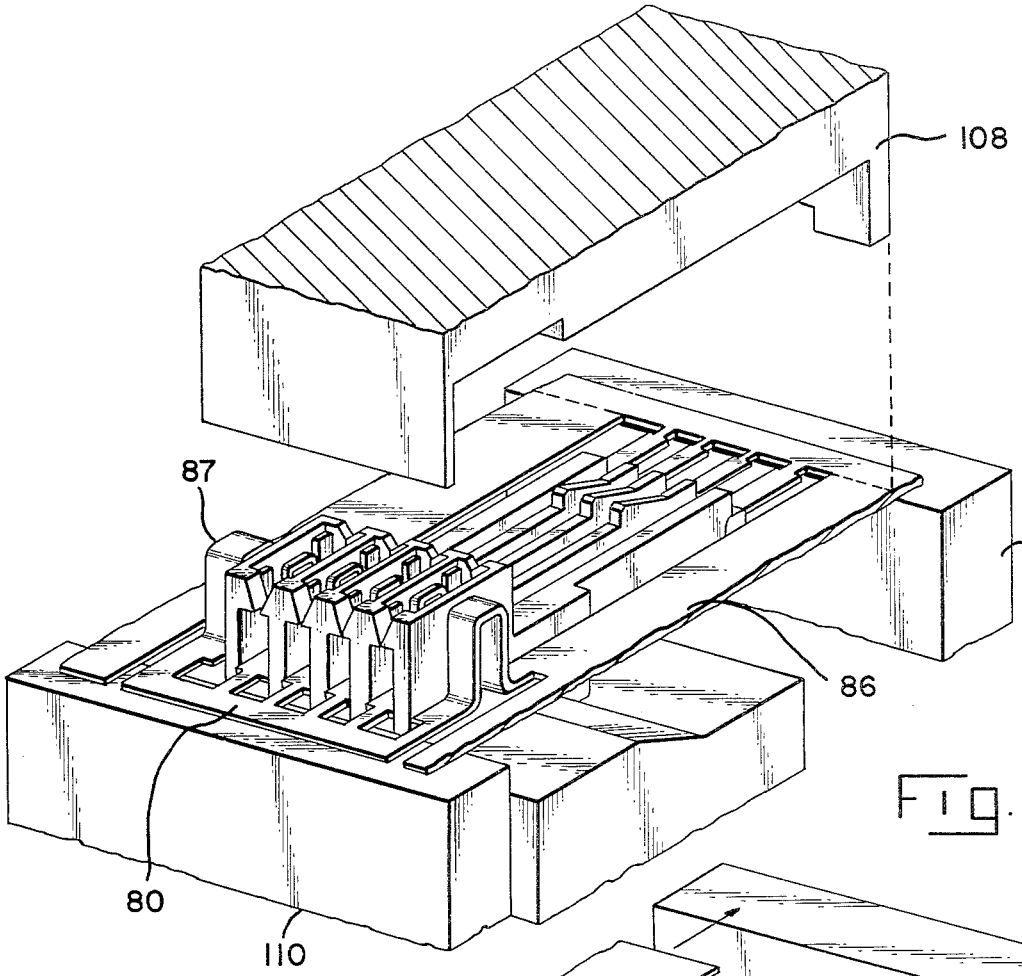
FIGS. 12 and 13 are views illustrating an alternative processing method for severing individual sub-assemblies from a strip.
Figure 13:
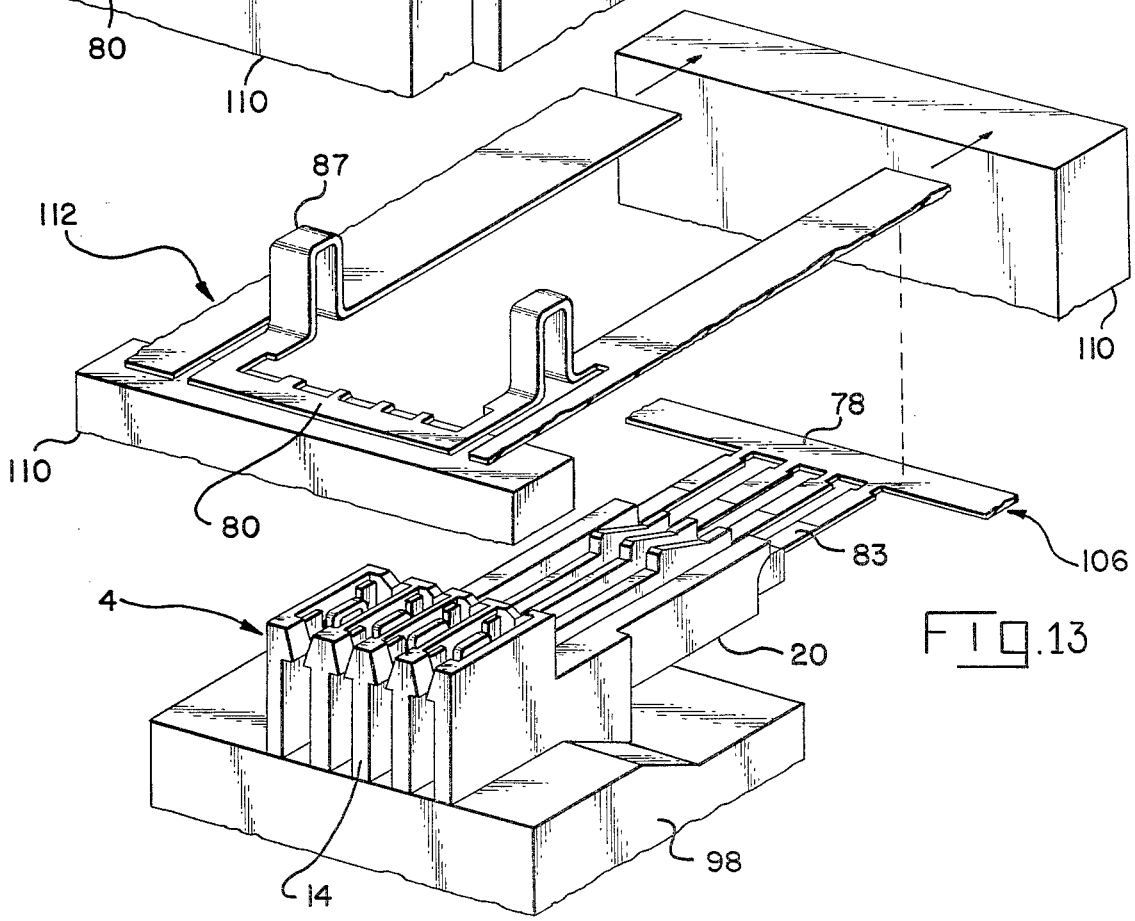

FIGS. 12 and 13 show an alternative processing method in which the shearing dies 108, 110 remove an individual sub-assembly from the composite strip but leave the first carrier strip 78 integral with the first ends of the conductors 34 so that the scrap strip is as shown at 112. The first carrier strip 78 can then be used to feed a continuous strip of sub-assemblies through machinery for carrying out the wire insertion process, as shown in FIG. 10. The carrier strip 78 is severed from the individual sub-assemblies when the conductors are bent downwardly by the bending die, shown at 100 in FIG. 11.

Figure 14:
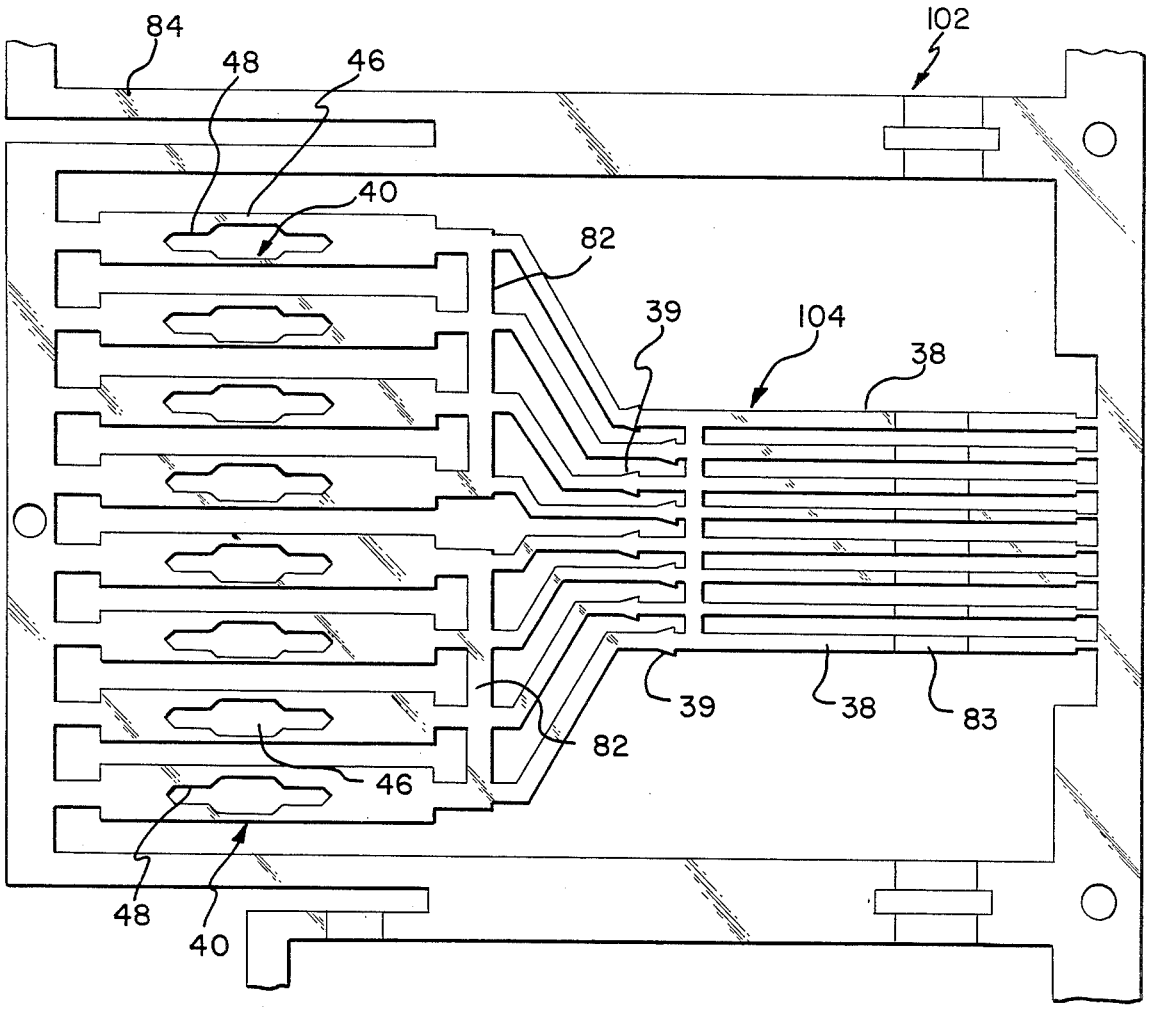
FIG. 14 is a plan view of a blank from which a strip of conductors is formed.

In FIG. 5, the conductors are produced in groups of four and are inserted into a sub-assembly which is designed to receive four conductors. Modular jacks are produced in three sizes having four conductors, six conductors, and eight conductors and it is possible to use a standard strip in manufacture of sub-assemblies of all three sizes. As shown in FIG. 14, the strip 102 can be provided with groups 104 of conductors having eight conductors to a group. When a sub-assembly containing eight conductors is being produced, all eight of the conductors in each group are used, however, if sub-assemblies having six or four conductors are being produced, it is only necessary to remove conductors on the sides of the group and reduce the number in the strip to that number required for the sub-assembly. Thus, if a four conductor sub-assembly is being produced, the two conductors on each side of the group are severed from the group prior to assembly of the remaining four conductors to the support member 10. The use of a strip, as shown in FIG. 14, reduces tooling costs in that a single die can be used to produce conductors for different sizes of modular jacks.

Several advantages are achieved in the practice of the invention. It is advantageous in itself to use stamped and formed conductors rather than wire conductors in a modular jack for the reason that gold plating is required on the contact portions of the contact spring members 36 of the conductors. Gold is not required on other portions of the conductor, such as the intermediate portions of the wire connecting portions. When stamped and formed conductors are used in modular jacks, gold can be selectively electrodeposited on a narrow band of the flat strip, as shown in FIG. 5, with the band located such that only the contact areas of the contact portions 36 will be gold plated and the use of gold will thereby be reduced to an absolute minimum. By way of comparison, it is usually found necessary when drawn wire conductors are used in modular jacks to plate the entire length of wire used and considerably more gold is required for plating for this reason.

The provision of slotted plate-type connecting means in sub-assemblies, in accordance with the invention, results in substantial economies in the production of the finished modular jack assembly in that the wires can be simply inserted into the connecting portions of the terminals and this operation can be carried out by means of insertion apparatus capable of inserting all of the wires in a single operation. The practice of the invention thus avoids the necessity of crimping the drawn wire conductors onto the stranded wires and then inserting the drawn wire conductors into the support member, as disclosed in U.S. Pat. No. 4,088,387. As previously mentioned, the fact that a continuous strip is in itself advantageous, in that the strip can be fed to the various machines required for the processing steps and the support members need not be handled individually.

We claim:

1. A continuous composite strip of electrical connector receptacle sub-assemblies of the type intended for assembly to an electrical connector housing to produce an electrical connector assembly, said strip comprising:

continuous metallic carrier strip means extending for the full length of said strip, each of said sub-assemblies comprising a group of side-by-side stamped conductors and an insulating support member, said conductors of each group extending transversely of, and being integral with, said carrier strip means, each conductor comprising a contact portion, an intermediate portion and a wire connecting portion, said intermediate portions being between said contact portions and said wire connecting portions, said contact portions and said intermediate portions of said conductors and said carrier strip means lying in a single plane, said wire connecting portions having platelike means extending normally from said single plane and having wire-receiving slot means therein, each of said insulating support members comprising a molded body having a first and second end, said second end being adjacent to said carrier strip means and said first end being spaced from said carrier strip means, said support member having first and second major surface portions which extend between said ends and which are substantially parallel to said single plane, said intermediate portions and said wire connecting portions of said conductors of each group being contained in the associated insulating support member in conductor receiving channels and cavities respectively, with said contact portions extending from said first end, said channels extending inwardly from one of said major surface portions, each of said platelike means being disposed in one of said cavities, whereby, upon insertion of wires into said slot means of said wire connecting portions of one of said groups of conductors, severing of the conductors of said group from said carrier strip means, and reversely bending said contact portions of said conductors through an obtuse angle towards said associated insulating support, said sub-assembly can then be assembled to a connector housing to produce a wired electrical connector.

2. A continuous composite strip as set forth in claim 1, said carrier strip means comprising first and second parallel spaced-apart carrier strips, each of said conductors having a first end which is integral with said first carrier strip and a second end which is integral with said second carrier strip, said second end of each of said support members being adjacent to said second carrier strip, said first end of said support member being between said carrier strips.

3. A continuous composite strip as set forth in claim 1, said cavities in said insulating body extending inwardly on said first major surface portions, and said conductor-receiving channels extending from said cavities to said first end of each support member, said intermediate portions of said conductors being inserted into said channels.

4. A continuous composite strip as set forth in claim 3, said plate-like means comprising a pair of side-by-side plate-like members having outer free ends which are spaced from said single plane, and spaced-apart integral connecting strap means extending between said free ends, said wire-receiving slot means comprising aligned slots in said pair of plate-like members.

5. A continuous composite strip as set forth in claim 4, said channels in each of said support members extending from said first major surface across said first end of said support member to said second major surface whereby portions of said conductors are inserted into said channels at said first end of said support member when said conductors are reversely bent.

6. A continuous composite strip as set forth in claim 1, said strip being wound on a reel.

7. A continuous composite strip of electrical connector sub-assemblies said sub-assemblies being of the type comprising a group of stamped and formed conductors and an insulating support member, said sub-assemblies being intended for assembly to an electrical connector housing, said strip comprising:

first and second parallel spaced-apart carrier strips, each of said groups of conductors comprising a plurality of side-by-side conductors extending transversely, and located between, said carrier strips, each of said conductors having a first end which is integral with said first carrier strip and a second end which is integral with said second carrier strip, each conductor comprising a contact spring portion, an intermediate portion, and a wire-connecting portion, said contact portion extending from said first end, said wire-connecting portion extending from said second end, said intermediate portion of each conductor being between said contact portion and said wire-connecting portion thereof, said first and second carrier strips, said contact portions of said conductors, and said intermediate portions of said conductors lying in a single plane, said wire-connecting portions of said conductors each having a generally U-shaped integral wire-connecting means comprising spaced-apart plate-like sections which extend sub-stantially normally of said single plane, said plate-like members having outer ends which are remote from said single plate and which are connected by spaced-apart connecting strap members, said plate-like members having wire-receiving slots therein which are dimensioned to receive, and establish electrical contact with, a wire upon movement of said wire laterally of its axis, between said strap members and into said slots, each of said insulating support members comprising a molded body having side surface portions which extend normally of said single plane, having major surface portions which extend substantially parallel to said single plane, and having first and second ends, said second end being adjacent to said second carrier strip, said first end being between said carrier strips, said intermediate portions and said wire-connecting portions of said conductors in each group being contained in the associated insulating support member of said group, said contact portions of each group extending from said first end of said associated support member to said first carrier strip, and, cavities extending into one of said major surface portions of said associated support member proximate to said second carrier strip, said wire connecting portions of said conductors being in said cavities whereby, upon insertion of wires into said cavities and into said wire-receiving portions of said conductors, and upon severing of said ends of said conductors from said carrier strips and reverse bending of said conductors at said first end of said support through an obtuse angle, said sub-assembly can then be assembled to said connector housing to produce a wired electrical connector.

8. A continuous composite strip as set forth in claim 7, said support member having a plurality of channels in said one major surface, said channels extending from said cavities to said first end, said conductors being inserted into said cavities and said channels.

* * * * *